United States Patent [19]

Marx et al.

[11] 3,986,773

[45] Oct. 19, 1976

[54] APERTURED CONVEYOR BELT FOR TRANSPORTING COPY MATERIAL

[75] Inventors: Gerhard Marx, Hahn, Taunus; Günter Kramer, Wiesbaden, both of Germany

[73] Assignee: Hoechst Aktiengesellschaft, Frankfurt, Germany

[22] Filed: Oct. 8, 1974

[21] Appl. No.: 513,144

Related U.S. Application Data

[63] Continuation of Ser. No. 324,068, Jan. 16, 1973, abandoned.

[30] Foreign Application Priority Data

Jan. 17, 1972 Germany ..... 2202205
Feb. 28, 1972 Netherlands ..... 7202558

[52] U.S. Cl. ..... 355/3 R; 198/846
[51] Int. Cl.[2] ..... G03G 15/00
[58] Field of Search ..... 355/3 R, 3 TR; 198/193, 198/41; 226/94; 271/DIG. 3, 193; 317/262 E

[56] References Cited

UNITED STATES PATENTS

| | | | |
|---|---|---|---|
| 3,368,933 | 2/1968 | Wicker | 198/193 UX |
| 3,511,564 | 5/1970 | Gawin et al. | 355/3 R |
| 3,671,118 | 6/1972 | Fantuzzo et al. | 355/3 R |

*Primary Examiner*—L. T. Hix
*Assistant Examiner*—James LaBarre
*Attorney, Agent, or Firm*—Stevens, Davis, Miller & Mosher

[57] ABSTRACT

A conveyor belt for use in electrophotographic copying apparatus, which conveyor belt has a plurality of apertures therein and comprises electrically insulating material that can be electrostatically charged, the size and the distribution of the apertures being such that sheet material on which a copy is to be produced can adhere by electrostatic attraction to the belt when the belt is installed in the apparatus and such that the tendency of the belt to impair the copy is less than that for a belt without apertures.

11 Claims, 2 Drawing Figures

APERTURED CONVEYOR BELT FOR TRANSPORTING COPY MATERIAL

Figure 1:
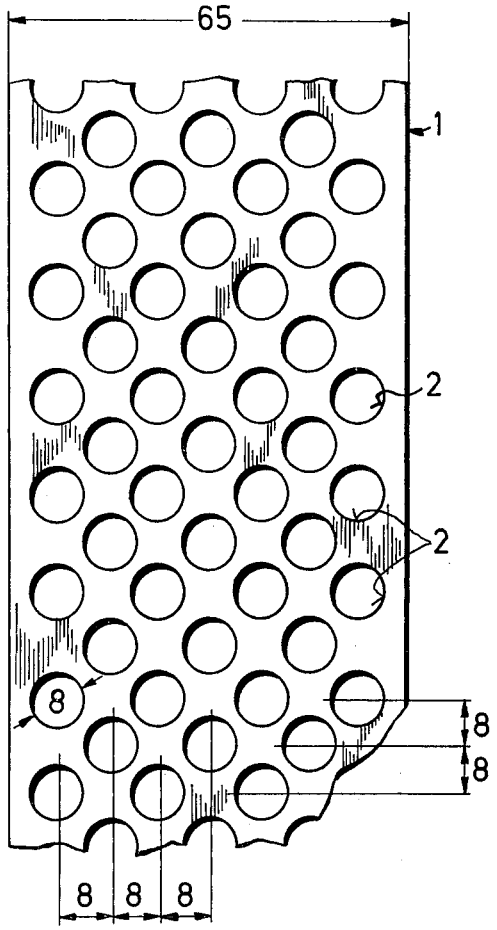

This is a continuation of application Ser. No. 324,068, filed Jan. 16, 1973, now abandoned.

The present invention relates to a conveyor belt suitable for conveying copying material in electrophotographic copying apparatus in which the copying material is uniformly charged on its face for the subsequent formation of the image-like pattern, and, for the purpose of conveying, is electrostatically charged on the underside in the presence of the conveyor belt.

The electrophotographic copying apparatus of the above-described type the copying material should be conveyed reliably in the apparatus and in a plane position with the assistance of the conveyor belt. This result may in some cases be achieved with a conventional belt, but it is found, that a conventional belt causes the counter electrode in the corona to be covered so that a shadow of the conveyor belt is cast onto the copy. A bright strip appears on the copy in the position where the belt runs. In order to obtain a satisfactory result, it has been necessary to work with at least two charging elements.

The present invention provides a conveyor belt for use in electrophotographic copying apparatus, which conveyor belt has a plurality of apertures therein and comprises an electrically insulating material that can be electrostatically charged, the size and the distribution of the apertures being such that sheet material on which a copy is to be produced can adhere by electrostatic attraction to the belt when the belt is installed in the apparatus and such that the tendency of the belt to impair the copy is less than that for a belt without apertures. The total area of the apertures is preferably at least 30 % of the area of the belt and any square area of the belt, the square having a side of approximately 1.5 cm, advantageously contains at least part of at least one aperture.

The conveyor belt of the invention makes possible the reliable conveying of the copying material by means of electrostatic forces between the copying material and the conveyor belt while undesired impairment of the copy by the conveyor belt is substantially eliminated.

The conveyor belt of the invention preferably has a width of from 4 cm to 10 cm, advantageously approximately 6,5 cm. The apertures are advantageously circular and each aperture may have a diameter of approximately 8 mm. In the latter case the apertures are preferably arranged in a square matrix, which matrix is arranged at approximately 45° to the direction of movement of the belt, the edge length of the unit cell of the matrix being approximately 1.1 cm.

The belt, which is preferably continuous, advantageously comprises a flexible substance or material that can be statically charged. The belt may comprise a plastics material, and advantageously comprises polyethylene. The thickness of the belt may be from 10 $\mu$ to 2 mm, preferably approximately 50 $\mu$.

In a preferred embodiment of the invention, the belt comprises a continuous insulating web with numerous macroscopic apertures, the apertures constituting approximately 30 % of the total area of the insulating web, and at least one such aperture being arranged in each square area, of approximately 1.5 cm edge length, of the insulating web. The figure of 30 % can, however, be exceeded considerably if the desired electrostatic adhesion between the conveyor belt and the copying material is sufficiently strong. Thus, the figure of 30 % was given for the adhesion of zinc oxide paper to a plastics web in the vertical position. If conveying occurs only in the horizontal direction the holding forces required are consequently lower, and the number and/or size of the apertures can be increased, a uniform shape and arrangement of the apertures resulting in a homogenous charge, and being preferred therefore.

The conveyor belt may also consist of an insulating belt of a flexible material which can be statically charged, e.g. of a flexible textile belt, coated with plastics or of a roughly woven belt of plastics filaments.

The fact that the use of a conveyor belt with apertures makes it possible to obtain good mechanical adhesion of the copying material to the belt while substantially or completely avoiding undesirable strip images is surprising. It is assumed, although this explanation is in no way limiting, that the charge on the underside of the copying material becomes very uniform because the charge can penetrate between the belt and the copying material by way of the apertures.

Figure 2:
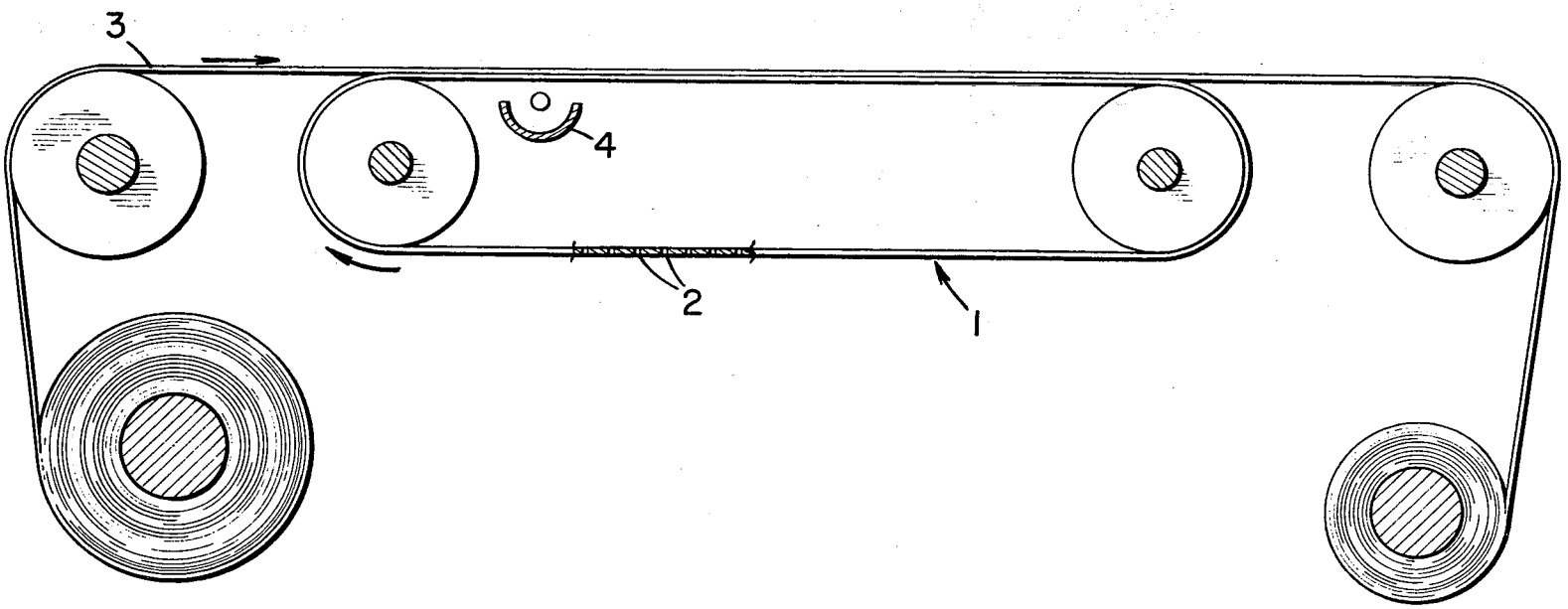

The invention will now be described, by way of example only, with reference to the accompanying drawings, in which FIG. 1 shows a section of the conveyor belt of the invention; and FIG. 2 shows the conveyor belt mounted for movement in contact with the copying material.

In FIG. 1 is shown a section of a conveyor belt 1 of approximately 50 $\mu$ thick polyethylene (HOSTAPHAN, a commercial product of Farbwerke HOECHST A.G.). In this web 1 circular apertures 2, having a diameter of 8 mm, are arranged in a square matrix arranged at 45° to the longitudinal direction of the web. The spacing between the apertures 2 perpendicular to the longitudinal direction of the web and in the longitudinal direction of the web is likewise 8 mm. The edge length of the unit cell of the square matrix is thus 1.1 cm. Four continuous conveyor belts of the described type of approximately 65 mm width were used in an electrophotographic copying apparatus for conveying through the apparatus ZnO paper sheets of DIN size A 4. The adhesion of the copying material sheets or web 3 to the conveyor belt as shown in FIG. 2 was excellent for many thousands of copies, and no undesirable shadow images of the conveyor belt or of the circular apertures were to be seen when the static charge of the layer was in the correct ratio to the exposure time corotron 4 creates the charges. Without the apertures it was impossible to avoid the formation of undesirable strips, very marked in contrast, produced on the copy by the insulating webs.

What is claimed is:

1. In an electrophotographic copying apparatus having a continuous conveyor belt for transporting a copy material and means for electrostatically charging an underside of said conveyor belt, the improvement in which said conveyor belt includes an electrically insulating web of continuous length having a plurality of apertures extending through the web from an upper side to a lower side, said both sides are electrostatically chargeable, said apertures avoiding undesirable strip images of the conveyor belt on the copy material and have a total surface area of at least 30% of the total area of the conveyor belt and are arranged in a matrix of inclined rows to the continuous length direction of the web, the connecting lines of the central points of the apertures in the inclined rows of the matrix defining an angle of approximately 45° with said length direction of the web.

2. The conveyor belt as claimed in claim 1, wherein the apertures are circular with a diameter of approximately 8 mm and the apertures are additionally arranged in rows normal and parallel respectively to said length direction of the web.

3. The conveyor belt as claimed in claim 2, wherein adjacent parallel rows are staggered with respect to the apertures in each row.

4. The conveyor belt as claimed in claim 2, wherein adjacent normal rows are staggered with respect to the apertures in each row.

5. The conveyor belt as claimed in claim 3, wherein the spacing in said length direction of the web between the central points of adjacent apertures of adjoining normal and staggered rows is 8 mm.

6. The conveyor belt as claimed in claim 4, wherein the spacing normal to said length direction of the web between the central points of adjacent apertures of adjoining parallel and staggered rows is approximately 8 mm.

7. The conveyor belt as claimed in claim 1, wherein the width of the belt is from 4 cm to 10 cm.

8. The conveyor belt as claimed in claim 1, wherein the width of the belt is 6.5 cm.

9. The conveyor belt as claimed in claim 7, wherein the belt has a thickness from 10 $\mu$ to 2 mm.

10. The conveyor belt as claimed in claim 7, wherein the belt has a thickness of 50 $\mu$.

11. The conveyor belt as claimed in claim 1, wherein the belt is comprised of a plastics material.

* * * * *